US007106266B1

(12) United States Patent
Pauley

(10) Patent No.: US 7,106,266 B1
(45) Date of Patent: Sep. 12, 2006

(54) TUNED ANTENNA ID READER

(76) Inventor: James D. Pauley, 5448 Lakeview Dr., Clear Lake, IA (US) 50428

( * ) Notice: Subject to any disclaimer, the term of this patent is extended or adjusted under 35 U.S.C. 154(b) by 0 days.

(21) Appl. No.: 11/128,475

(22) Filed: May 14, 2005

Related U.S. Application Data

(60) Provisional application No. 60/571,016, filed on May 14, 2004.

(51) Int. Cl.
*G08B 26/00* (2006.01)
*G08B 13/14* (2006.01)
*H01Q 7/08* (2006.01)

(52) U.S. Cl. ..... 343/788; 343/742; 340/505; 340/572.2

(58) Field of Classification Search ..... 343/742, 343/867, 788, 895; 340/505, 572.2
See application file for complete search history.

(56) References Cited

U.S. PATENT DOCUMENTS

| | | | | |
|---|---|---|---|---|
| 1,454,629 | A * | 5/1923 | Elliott | 375/315 |
| 6,307,468 | B1 * | 10/2001 | Ward, Jr. | 340/505 |
| 6,343,429 | B1 * | 2/2002 | Mossberg et al. | 42/70.01 |
| 6,680,709 | B1 * | 1/2004 | Kitagawa | 343/742 |
| 2006/0012482 | A1 * | 1/2006 | Zalud et al. | 340/572.7 |

* cited by examiner

*Primary Examiner*—Tan Ho
(74) *Attorney, Agent, or Firm*—D L Tschida

(57) ABSTRACT

A multi-coil antenna array constructed with a tuned transformer to null mutual inductance. First and second antenna coil halves are displaced longitudinally on opposite sides of a pathway along which ID tags pass, for example, a chute assembly. The planar coils are displaced at a selected angular orientation and driven with inputs having a 90° phase differential to create an intermediate vertical field with a vertical axis of rotation. Identification data stored in tags attached to animate or inanimate objects passing through the field is interrogated, such as data identifying people, animals, inventory or any other parameters of interest.

6 Claims, 3 Drawing Sheets

TUNED ANTENNA ID READER

RELATED APPLICATION DATA

Non-provisional of provisional application No. 60/571,016 filed May 14, 2004.

BACKGROUND OF THE INVENTION

The present invention relates to identification tag readers and, in particular, to an antenna array having a rotating field around a vertical axis perpendicularly aligned to the travel path of an ID tag passing through the field to assure data capture.

A problem associated with RFID technology is that with any reader-tag combination various orientations of a tag relative to a reader antenna exist in which there is no communication between the tag and the reader. The missing data and ensuing errors are not readily compensated without performing redundant read operations. Inanimate tagged objects can be positioned to avoid the problem. However, tagged people, animals or objects having random orientations can pass through a reader magnetic field without being identified where the pattern of the reader field and the orientation of the tag provide marginal field coupling.

An illustrative example of the latter circumstance might occur with a cow passing through a reader station located in an "alleyway" or chute. The antennas used with this type of reader often consist of two vertical panels mounted parallel to each other about 3 feet apart. Each panel contains a large air coil. The coils are driven such that the individual fields are either opposing or enhancing. In either case, a cow can pass through the magnetic field established by the antennas with its tag oriented such that it cannot be detected.

U.S. Pat. No. 6,307,468 teaches the use of antenna coils mounted in such a way that the antenna coils do not exhibit a mutual inductance (i.e. a coupling of their respective fields). In particular, the antenna coils are driven with currents differing in phase by 90°. Fewer non-functional reader-tag orientations are thereby obtained.

A common construction of the foregoing antenna is to vertically mount one coil inside another with the planes of the coils positioned 90° apart. Such a configuration and drive results in a magnetic field inside the coil structure that appears to rotate within the coils, with the axis of rotation aligned to the intersection of the two coil planes. A tag passing through the field in any orientation except horizontal (i.e. perpendicular to the axis of rotation) can be read. In the case of ear tags on cows, the horizontal tag orientation is a very unlikely orientation.

A disadvantage of the foregoing crossed coil reader antenna is that the physical antenna coils include a wireway or conduit that mounts over the top and across the bottom of the walkway containing the coils, thus presenting an open-ended tubular alleyway. The conduit containing the antenna coils occupies four sides of a six sided cube space, which makes it difficult or impractical to implement and use. It can cause animals to balk at passing the antenna, which can interfere with the handling of the animals, particularly by riders on horseback.

The subject antenna and reader was therefore constructed to provide an antenna array with a rotating field between the coils of two antennas with no mutual inductance apparent between the coils. The elimination of mutual inductance is difficult to obtain in practice. The subject antenna constructions, however, provide coils that can be mounted in non-ideal arrangements with the mutual inductance between them being compensated or nulled by an external means. More convenient physical arrangements of the antennas are thereby made possible, including arrangements that allow open top alleyways.

SUMMARY OF THE INVENTION

It is a primary object of the present invention to provide an RFID tag reader assembly having an antenna coil array that exhibits no effective mutual inductance.

It is a further object of the invention to provide an antenna array that includes a transformer with an adjustable core piece to null mutual inductance between the coils.

It is a further object of the invention to provide an antenna array comprised of two planar antennas, each containing a pair of spiral wound coil halves of which are formed adjacent to each other in the two planar panels.

It is a further object of the invention to position the foregoing planar panels opposite to one another along a pathway traversed by objects containing RFID tags and couple 90° phase shifted drive signals to each coil to create a rotating field with a vertical axis of rotation.

It is a further object of the invention to drive the coils with signals at exemplary frequencies in the ranges of 125 KHZ, 134.2 KHZ, 13.56 MHZ or 2.4 GHZ.

The foregoing objects, advantages and distinctions of the invention, among others, are found in a presently preferred antenna array that provides first and second planar coil antennas. The coils are wound in portions (e.g. halves) that are positioned on opposite sides of a pathway along which ID tags pass. The portions of each coil are longitudinally displaced from each other approximately 45° relative to the longitudinal centerline of the pathway. A variable transformer, constructed of a bifilar winding on a hollow core form and having a slide-adjusted ferrite core piece, is coupled to the coil portions to permit the nulling of mutual inductance between the coils. Associated 90°phase shifted coil drive circuitry operating at a selected frequency produces an intermediate rotating vertical field.

Still other objects, advantages and distinctions of the invention will become more apparent from the following description with respect to the appended drawings. Considered alternative constructions, improvements or modifications are described as appropriate. The description should not be literally construed in limitation of the invention. Rather, the scope of the invention should be broadly interpreted within the scope of the further appended claims.

DESCRIPTION OF THE PREFERRED EMBODIMENT

Figure 1:
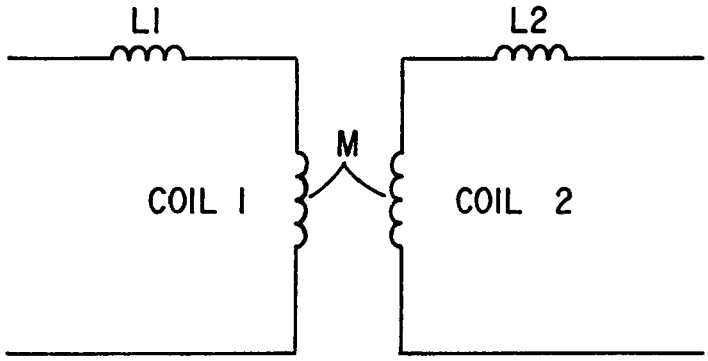
FIG. 1 is a schematic showing the mutual inductance between two coil antennas.

With attention to FIG. 1, a schematic of an RFID antenna array is shown that consists of two coils C1 and C2, each coil C1 and C2 having an inductance L1 and L2. The inductance L1 and L2 is determined by the numbers of windings at each coil C1 and C2 and the area enclosed by the windings. The coils C1 and C2 are normally constructed as flat panels in flat spiral wound configurations with an air core. The coils C1 and C2 when mounted in close proximity to each other (e.g. less than 5-feet apart) define an RFID antenna that detects data stored in transponder tags mounted to objects passing in close proximity to the coils C1 and C2.

If the coils are identical, the inductances L1 and L2 will also be the same. Except in very special cases such as the crossed coils described in U.S. Pat. No. 6,307,468, a mutual inductance M occurs due to the coupling between the magnetic fields of the coils C1 and C2.

Unless M=0, it is impossible to simultaneously maintain a tuning of the antenna coils C1 and C2 to a preferred frequency and maintain a 90° phase shift between the fields. If a method or apparatus can be found to make M appear to be zero, then antenna configurations other than crossed coils at 90° and derivatives thereof become possible.

Figure 2:
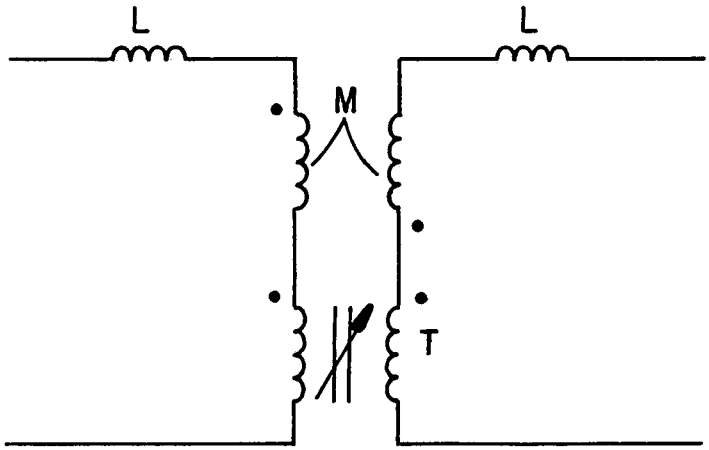
FIG. 2 is a schematic of a two-coil antenna array with a mutual inductance tuning transformer.

The present invention overcomes the effects of the mutual inductance M by including a variable transformer T in the antenna array, such as shown in the schematic diagram of FIG. 2. The transformer T is capable of compensating for the existence of a non-zero M. In particular, the coupling effect of the mutual inductance is negated by the addition of the variable transformer T.

The transformer T presents a variable coupling between the coils C1 and C2 that exhibits a polarity opposite to that of the mutual inductance M. By tuning the inductance of T, the effect of the inductive coupling between the coils C1 and C2 can be nulled, which allows the coils C1 and C2 to be driven 90° out of phase. Assuming also that M is small with respect to L, most of the field energy remains in L1 and L2.

Figure 3:
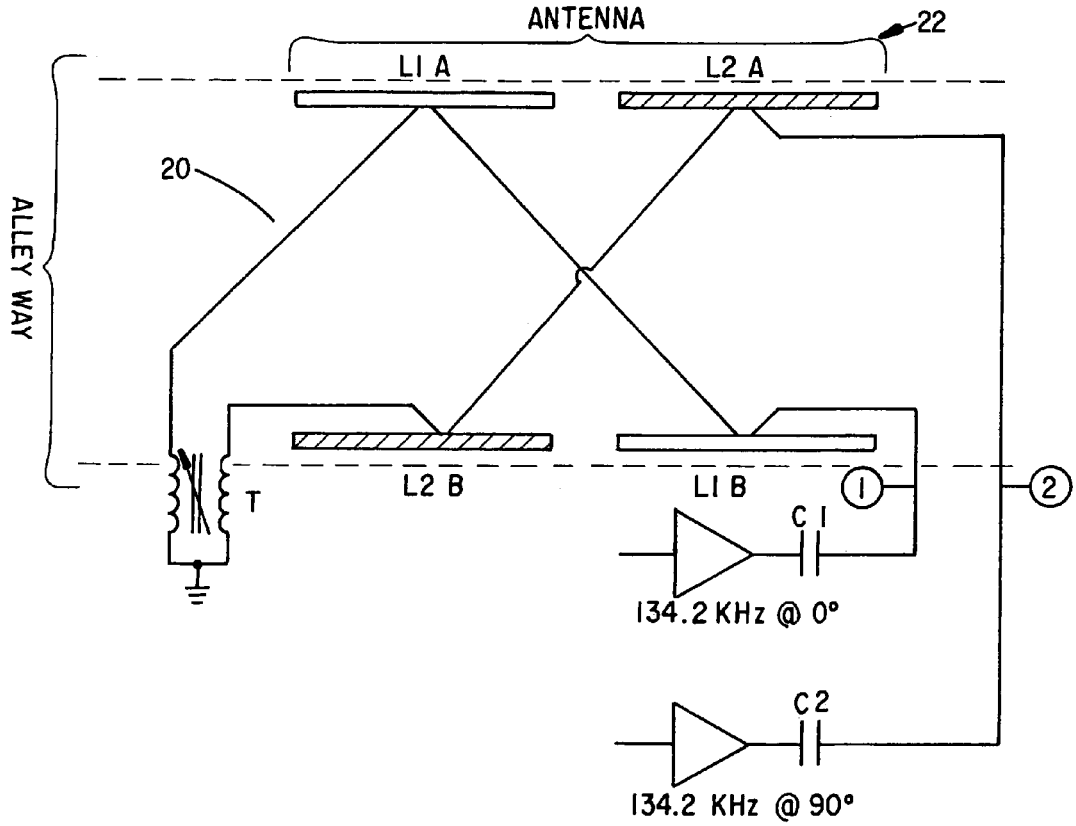
FIG. 3 is a schematic of a two-coil antenna array with a mutual inductance tuning transformer tuned to provide a rotating vertical field located to read identification data from tags passing through the field.
Figure 6:
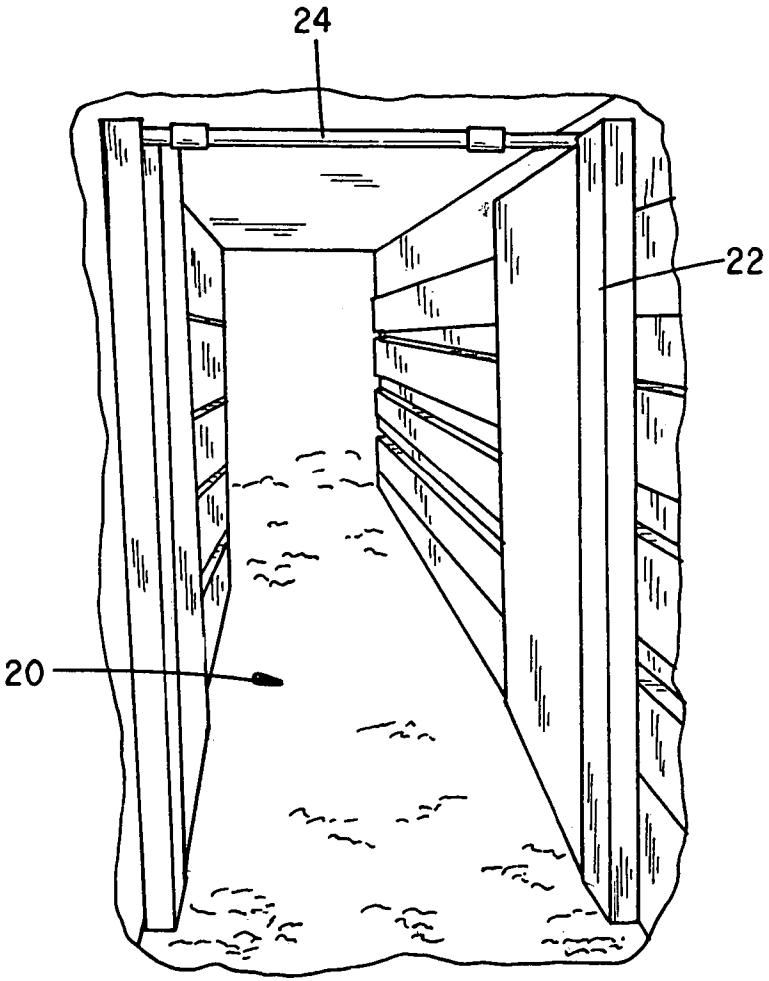
FIG. 6 is a drawing of the antenna array of FIG. 5 showing the planar parallel orientation of the flat coil antennas.
Figure 5:
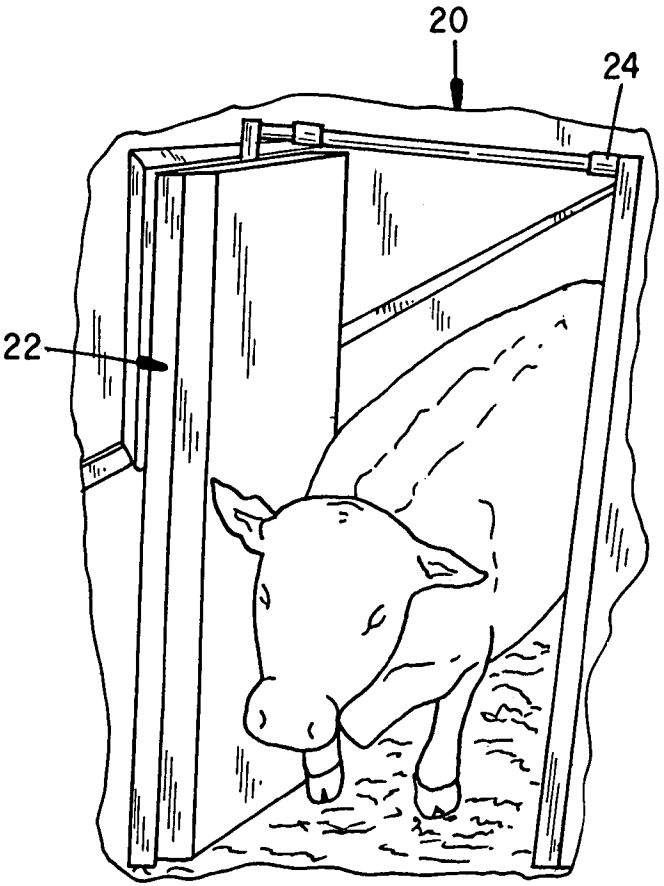
FIG. 5 is a drawing of an RFID antenna array located in an "alleyway" defined between a building wall and a stock pen to provide a rotating magnetic field with a vertical axis defined between two flat panel antennas, which field is situated to read identification data from the ear tags of animals passing through the field.

With attention to FIG. 3 and also to FIGS. 5 and 6, an antenna array utilizing the concept of FIG. 2 is shown as it appears in a normal "alleyway" 20, such as through which cattle are driven. A first antenna coil L1 is divided into two coil portions, L1A and L1B. The coils L1A and L1B are wired such that the fields enhance each other. The coils L1A and L1B measure approximately 21"×58" and are mounted on opposite sides of the alleyway 20, which is about 33" wide. The coils L1A and L1B are laterally offset from each other along opposite sides of the alleyway 20 so that the generated magnetic field is oriented approximately 45° to the direction of travel and the longitudinal centerline of the alleyway 20.

A second antenna coil L2 having coil halves L2A and L2B is similarly constructed and its field is also offset approximately 45° to the alleyway 20 and 90° to the field of L1. A transformer T is tuned so that a field generated on L1 does not induce a voltage at test point 2 and similarly, a field from L2 does not induce a voltage at test point 1. Thus, there is no apparent coupling between the coils L1 and L2 and they can be tuned and driven through resonating capacitors C1 and C2 by drive signal sources 90° out of phase to each other. For the depicted antenna array 22, the antenna coils L1 and L2 are tuned to a 134.2 KHZ frequency. Other frequencies that find advantage in differing applications, such as personal monitor bracelets and tags used with inanimate objects such as laundry and items stored on a pallet are 125 HZ, 13.56 MHZ and 2.4 GHZ.

The capacitors C1 and C2 are contained in a protective housing near the coils L1 and L2 along with appropriate AC powered drive circuitry for the coils L1 and L2. The housing also contains conventional antenna driver circuitry, along with the nulling-transformer T. Microprocessor based circuitry and/or communication circuitry (e.g. network or internet) may also be included to facilitate data storage, manipulation and/or communication. The housing and drive circuitry is typically mounted adjacent or in close proximity to the antenna array 22 where it is not susceptible to damage.

The resultant "reader" field is a rotating field centered within the alleyway 20 with a vertical axis of rotation. A transponder ID tag contained on or in an animal passing along the alleyway 20 and through the field in any orientation other than horizontal can thereby be energized and read.

The antenna array 22 shown at FIGS. 5 and 6 can be constructed with no overhead obstruction if the coil interconnections are placed on or underground. If an overhead crossover conduit 24 is used, such as shown in FIG. 5, the conduit 24 should be placed sufficiently above the antenna array 22 such that the cattle/animals don't balk at passing along the alleyway 20.

Figure 4:
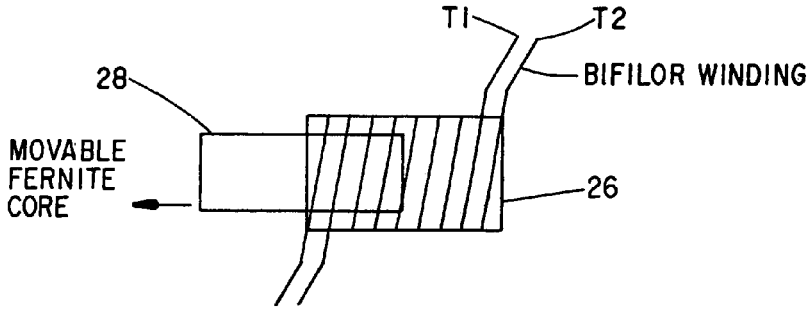
FIG. 4 is an assembly diagram of the "nulling" or tuning transformer.

Returning attention to FIG. 4, the physical construction of the transformer T is shown. The transformer T comprises a hollow non-magnetic 26 form on which bifilar windings W1 and W2 (e.g. 20 turns each) are wound. The bore of the form 26 is sized and shaped to receive a moveable ferrite core 28 that can be positioned in the bore such that the mutual inductance M between the antenna coils L1 and L2 can be nulled.

L1 connects to one of the transformer windings W1 and W2 and L2 connects to the other transformer winding W1 and W2. For the circuit of FIG. 3, L1 and L2 connect to the same end of the transformer windings W1 and W2. For other antenna configurations, the antenna coils L1 and L2 may be attached to opposite ends of the transformer coils W1 and W2.

While the invention has been described with respect to a presently preferred antenna array and considered improvements or alternatives thereto, still other antenna and nulling transformer constructions may be suggested to those skilled in the art. It is also to be appreciated that selected ones of the foregoing components can be used singularly or can be arranged in different combinations to provide a variety of improved antennas. The foregoing description should therefore be construed to include all those embodiments within the spirit and scope of the following claims.

What is claimed is:

1. An antenna for reading RFID tags comprising:

a) first and second planar coils, wherein the coils are wound in planar portions positioned adjacent to one another on first and second supports; and b) a transformer having first and second windings wound on a hollow core form and a ferrite core piece mounted in a bore of said core form, whereby the slide adjustment of said core permits the nulling of mutual inductance between the coils and 90° phase shifted drive signals coupled to said coils and transformer to produce an intermediate field around a vertical axis of rotation.

2. An antenna as set forth in claim 1 wherein said first and second supports comprise planar panels and wherein the portions of each coil at said first and second panels are longitudinally displaced from each other approximately at 45°.

3. An antenna as set forth in claim 1 wherein the frequency of said drive signals comprises 125 KHZ, 134.2 KHZ, 13.56 MHZ or 2.4 GHZ.

4. An RFID antenna interrogation station comprising:

a) first and second panels containing planar wound coil portions mounted on opposite sides of a pathway along which media containing RFID data passes;

b) a transformer having a position adjustable core piece, whereby the adjustment of said core piece permits the nulling of mutual inductance between the coil portions and phase shifted drive signals coupled to said coil portions and transformer to produce an intermediate field around a vertical axis of rotation.

5. An antenna as set forth in claim 4 wherein the portions of each coil at said first and second panels are longitudinally displaced from each other approximately at 45°.

6. An antenna as set forth in claim 5 wherein the frequency of said drive signals comprises 125 KHZ, 134.2 KHZ, 13.56 MHZ or 2.4 GHZ.

* * * * *